US009086027B2

(12) United States Patent
Lucano et al.

(10) Patent No.: US 9,086,027 B2
(45) Date of Patent: Jul. 21, 2015

(54) HYSTERESIS-TYPE ELECTRONIC CONTROLLING DEVICE FOR FUEL INJECTORS AND ASSOCIATED METHOD

(75) Inventors: Massimo Lucano, Alessandria (IT); Gianluca Botto, Turin (IT); Marcello Chiaberge, Collegno (IT); Mirko Degiuseppe, Vinovo (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 887 days.

(21) Appl. No.: 13/320,426

(22) PCT Filed: Mar. 27, 2010

(86) PCT No.: PCT/EP2010/001956

§ 371 (c)(1),
(2), (4) Date: Nov. 14, 2011

(87) PCT Pub. No.: WO2010/130320

PCT Pub. Date: Nov. 18, 2010

(65) Prior Publication Data

US 2012/0055449 A1 Mar. 8, 2012

(30) Foreign Application Priority Data

May 14, 2009 (GB) ..... 0908262.9

(51) Int. Cl.
*F02M 51/00* (2006.01)
*F02D 41/20* (2006.01)
*H01F 7/18* (2006.01)

(52) U.S. Cl.
CPC ..... *F02D 41/20* (2013.01); *F02D 2041/2017* (2013.01); *F02D 2041/2024* (2013.01); *F02D 2041/2058* (2013.01); *H01F 2007/1866* (2013.01)

(58) Field of Classification Search
CPC ..... F02D 41/34; F02D 41/345; F02D 41/28; F02D 2041/281; F02D 2041/286; F02D 41/30; F02D 41/20; F02D 2041/202; F02D 2041/2048; F02D 2041/2055; F02D 2041/2058
USPC ..... 123/478, 479, 480, 488, 490
See application file for complete search history.

(56) References Cited

U.S. PATENT DOCUMENTS 4,452,210 A * 6/1984 Sasayama et al. ..... 123/490
4,970,622 A * 11/1990 Buchl ..... 361/154

(Continued)

FOREIGN PATENT DOCUMENTS

DE 4341797 A1 6/1995
DE 102007005303 A1 8/2008
DE 102007020968 A1 11/2008
EP 0400389 A2 12/1990
WO 9919615 A1 4/1999

OTHER PUBLICATIONS

International Searching Authority, International Search Report for Application No. PCT/EP2010/001956, dated Jul. 2, 2010.

(Continued)

*Primary Examiner* — Thomas Moulis
(74) *Attorney, Agent, or Firm* — Ingrassia Fisher & Lorenz PC

(57) ABSTRACT

A hysteresis-type electronic controlling device is provided for fuel injectors that includes, but is not limited to a power driving unit for driving the fuel injectors with an electric signal, a control stage connected to the power driving unit and a sensing stage fed by the power driving unit and feeding the control stage, the device has a feedback frequency control stage for measuring a waveform period of the signal feeding the fuel injectors; the feedback frequency control stage is fed by the control stage with an electric signal. A fuel injector control method is also provided that includes, but is not limited to driving fuel injectors with an electric signal coming from a power driving unit fed by a control stage , sensing the signal with a sensing stage, and measuring a waveform period of the signal through the feedback frequency control stage.

9 Claims, 3 Drawing Sheets

(56) References Cited

U.S. PATENT DOCUMENTS

| | | | | | |
|---|---|---|---|---|---|
| 4,978,865 | A | * | 12/1990 | Hartmann et al. | 307/140 |
| 5,053,911 | A | | 10/1991 | Kopec et al. | |
| 5,251,091 | A | * | 10/1993 | Ito et al. | 361/152 |
| 5,592,921 | A | | 1/1997 | Rehbichler | |
| 5,941,216 | A | * | 8/1999 | Arakawa | 123/490 |
| 6,483,689 | B1 | | 11/2002 | Koch et al. | |
| 6,571,773 | B1 | * | 6/2003 | Yamakado et al. | 123/490 |
| 6,766,789 | B2 | * | 7/2004 | Yamakado et al. | 123/490 |
| 7,089,915 | B2 | * | 8/2006 | Guenther et al. | 123/490 |

OTHER PUBLICATIONS

SIPO, Chinese Office Action for Application No. 2010800210156, dated Aug. 30, 2013.

SIPO, Chinese Office Action for Application No. 2010800210156, dated May 30, 2014.

SIPO, Chinese Office Action for Application No. 2010800210156, dated Dec. 15, 2014.

* cited by examiner

HYSTERESIS-TYPE ELECTRONIC CONTROLLING DEVICE FOR FUEL INJECTORS AND ASSOCIATED METHOD

CROSS-REFERENCE TO RELATED APPLICATIONS

This application is a U.S. National-Stage entry under 35 U.S.C. § 371 based on International Application No. PCT/EP2010/001956, filed Mar. 27, 2010, which was published under PCT Article 21(2) and which claims priority to British Application No. 0908262.9, filed May 14, 2009, which are all hereby incorporated in their entirety by reference.

TECHNICAL FIELD

The technical field relates to the field of the controlling devices for fuel injectors and in particular deals with a hysteresis-type electronic controlling device for automotive injectors and associated method.

BACKGROUND

It is known that fuel injectors, used to inject a fuel-air mixture in the combustion chamber of an engine can be injectors, principally piezoelectric or solenoidal. In particular, injectors are driven by electronic controlling devices that comprise a power stage designed to drive them with a proper current or voltage signal.

It is also known that the standard control techniques for current generation in the power stage of the aforementioned devices are principally PWM or average current mode stages. Even if they do not present sub-harmonic instability, they actually introduce delays with respect to the switching frequency; thus, those delays force the designers to construct control loop stages operating with a frequency that is at least three or four times lower than the switching frequency of the power stage.

To solve this problem, control loop stages have been designed with a reduced time delay; that type control loop stages operate typically with two different circuit configurations, known in the art as a "peak current mode circuit" and "valley current mode circuit". Driving fuel injectors with "peak current mode circuits" or "valley current mode circuits", even if produces a reduced time delay, present instability.

In fact the power stage typically operates over MOS or FET transistors having a common switching node connected to the load (the injector) that presents a lot of ringing due to the reactive parasitic components. Since the control loop stages operate sensing the current on that node, there is the need of a blanking time before the sensing (typically around 300 ns). In particular when the load presents a very high duty cycle (bigger than 50%), sub harmonic instability occurs.

The peak or valley current mode circuits instability can be solved by using circuits with hysteretic current mode circuits, with a quasi-constant period that provide adequate stability of the current control loop. Nevertheless, the known circuits still present some disadvantages; on one hand they do need particularly complex circuits that make the measurement of the frequency (or the period) very convoluted. On the other and, they do not give sufficient performances when used with injectors that operate with high frequencies. In particular, if the injector operates with frequencies higher than a hundredth of kilohertz, the switching frequency becomes too high for those circuits, thus making a stable and simple control loop stage technically not feasible.

In view of the foregoing, it is at least desirable to provide a hysteresis-type electronic controlling device for fuel injectors that is free of the aforementioned disadvantages. It is also at least desirable to provide a fuel injector control method. In addition, desirable features and characteristics will become apparent from the subsequent summary and detailed description, and the appended claims, taken in conjunction with the accompanying drawings and this background.

SUMMARY

A hysteresis-type electronic controlling device is provided for fuel injectors and a method is provided for controlling a fuel injector.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
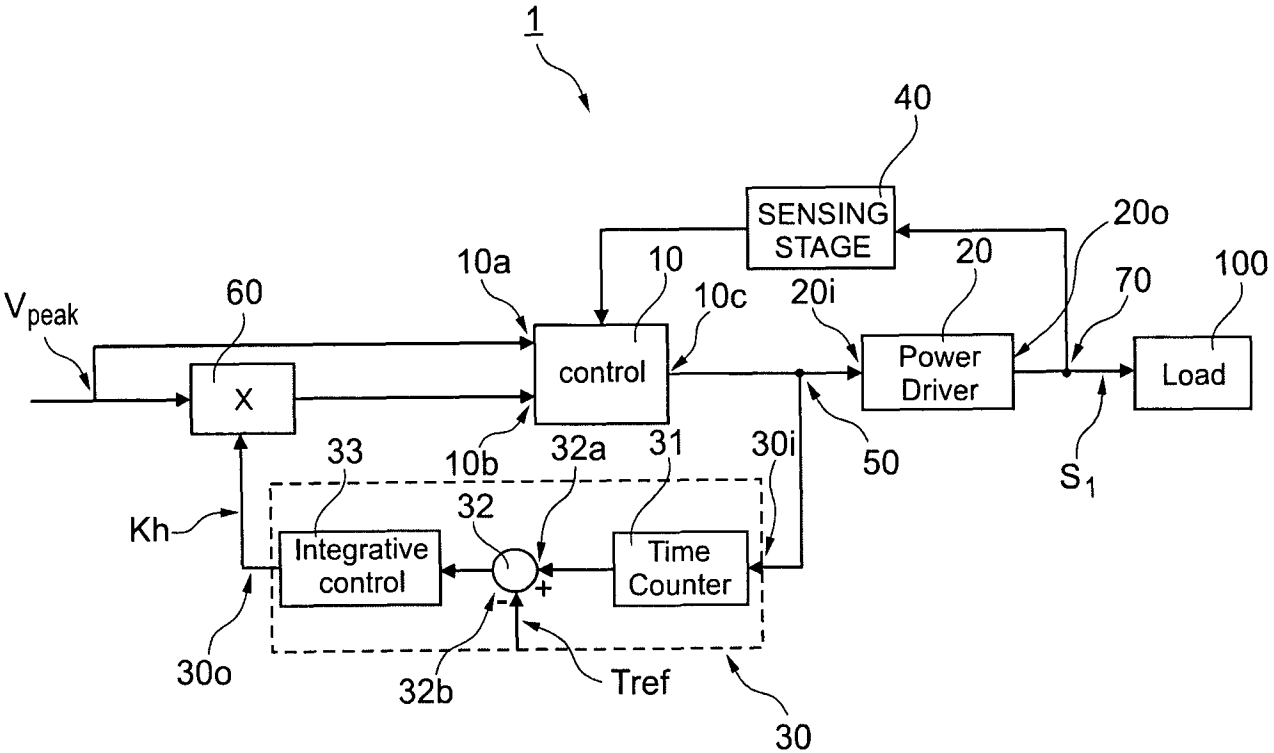
FIG. 1 shows a block scheme for a first embodiment of a hysteresis-type electronic controlling device for fuel injectors.

With reference to FIG. 1, with the reference number 1 is indicated, in its integrity, a hysteresis-type electronic controlling device for fuel injectors. The device 1 comprises: a driving unit control stage 10, having a first, a second and a third input port 10*a*, 10*b*, 10*d* and one output port 10*c;* a power driving unit 20, having a respective input port 20*i* and an output port 20*o* for feeding with an electric power signal $s_1$ at least one fuel injector electrically represented by the load 100; a feedback frequency control stage 30, having an input 30*i* and an output 30*o;* and a signal sensing stage 40, for detecting the magnitude of the electric signal $s_1$ fed to the load 100.

In detail, the control stage 10, has the first output port 10*c* connected through a wire line to a node 50 from which depart a first line directed to the input 20*i* of the power driving unit 20 and a second line feeding the input 30*i* of the frequency feedback control stage 30. The output 30*o* of the frequency feedback control stage 30 feeds a multiplier 60 on a first input, while its second input is fed with a reference signal $V_{peak}$ that defines the maximum magnitude of the electric signal fed to the load 100. The reference signal is also fed to the first input port 10*a* of the control stage 10.

Figure 2:
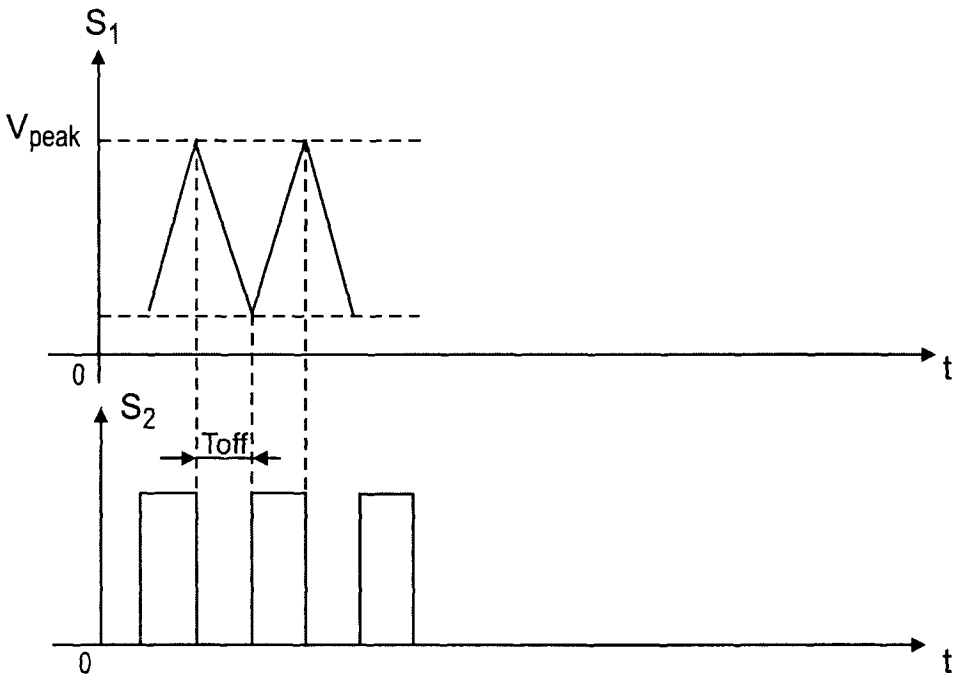
FIG. 2 shows a timing diagram of signals present in the device of FIG. 1.

In detail, as shown in FIG. 2, the electric signal $s_1$ fed to the load 100 assumes a triangular waveform having a proper ripple defined by the peak value, that is equal to the reference signal $V_{peak}$, and a valley value that defines the minimum magnitude of the signal.

The change of slope sign of the signal $s_1$ depends on the signal $s_2$ that control stage 10 feeds to the node 50—and thus to the input 20*i* of the power driving unit 20—from its output port 10*c*. In detail $s_2$ assumes a squared waveform in which every period is defined by a first time $T_{off}$ in which it assumes a first lower value and a second time Ton in which it assumes a second value higher than the first.

The power driving unit 20, a D class type amplifier, must be able to drive the load 100, thus producing on its output 20*o* the electric signal $S_1$, to drive the load 100 in current or equivalently in voltage. Clearly, on the basis of the type of driving, the sensing stage 40 can be respectively a current sensing stage or a voltage sensing stage of known type. The power driving unit 20, in particular, can be a buck converter, a boost converter or a buck-boost converter In detail, the fuel injector represented by the load 100 varies the way it opens on the basis of the magnitude of the electric signal $S_1$; in detail, the higher it is, the faster the injector opens. The present-day fuel injectors operate very fast, with multiple fuel shots for each cycle of the engine on which they operate; in particular applications they can produce fuel shots requesting electric signals $S_{pzi}$ that can reach frequencies 1 MHz. For this reason also the power driving unit 20 shall be designed in order to be able to produce this type of current or voltage signal. The output 20*o* of the power driving unit 20 is connected to a respective node 70 from which two different lines depart. A first line reaches the input of the load 100, while the second line reaches the input of the sensing stage 40, whose output is connected to and feeds through a line 41 the third input port 10*d* of the current control stage 10.

The control stage 10 operates with a hysteretic electric signal variation. In detail, it receives the on the first and second input ports 10*a*, 10*b* respectively the peak value $V_{peak}$ and the valley value that is produced by the multiplication of the peak value $V_{peak}$ with the electric signal fed to the multiplier 60 by a corrective signal coming of the feedback frequency control stage 30, whose details will be described in detail in the following part of the description; with a known circuit configuration, the control stage 10 generates on its output port 10*c* the reference signal $s_2$, that assumes the first lower value during the period of time in which the electric signal $s_1$, sensed by the sensing stage 40, is higher than the reference signal $V_{peak}$ that assumes the second higher value during the period of time in which the electric signal $s_1$ is lower than the reference signal $V_{peak}$. The control stage 10 is designed in order to keep the valley value of the signal $s_1$ as a gain (always below the 100%) of the reference signal $V_{ref}$.

Finally, frequency feedback control stage 30 comprises a time counter 31, having the input directly connected to the input 30*i* of the frequency feedback control stage 30 and an output connected to a first input 32*a* of an adder 32, in turn having a second input 32*b* that receives a reference timing signal $T_{ref}$, whose magnitude is decided a-priori by a value that can be constant in time or modulated with a very low frequency (typically up to 10 Hz but, anyway, several magnitude orders lower than the switching frequency of the driving unit 20).

The adder 32 has an own output 32*c* that is directly connected to the input of an integration stage. The time counter 31, measures the period between two positive edges of the signal $s_2$ and produces on its output a respective signal $T_{m's}$ that is the result of the aforementioned measure. The signal $T_{mis}$ assumes a waveform whose magnitude directly depends on the measured value itself Thus, through the time counter 31 is also measured of the signal $s_i$. Then the adder 32 executes the difference of the reference timing signal $T_{ref}$ present on its second input 32*b* with respect to the signal $T_{mis}$ present on its first input 30*a* and coming from the output of the time counter, producing on its output 30*c* a difference signal $e_T(t)$ that reaches the input of the integrator 33.

The integrator 33 generates a hysteretic corrective signal $k_h$ that feeds one of the inputs of the multiplier 60. In detail, the integrator 33 is included in order to achieve a smoothed response of the variation of the corrective signal $k_h$ to the variation of the difference signal $e_T(t)$. In fact, if the device 1 as disclosed would be deprived of the integrator 33, at a step change of the difference signal $e_T(t)$, would result a variation of the corrective signal $k_h$ having a step waveform too. In contrast, due to the presence of the integrator 33, there is a smoothed response in the variation of the corrective signal $k_h$, even in case of abrupt changes of the difference signal $e_T(t)$.

In detail, the feedback frequency control stage 30 can be designed so as to work in discrete or continuous time domain. In the first case, that is the one presented in the following part of the description, the sampling frequency shall be kept sufficiently high so as to avoid aliasing problems and so as to provide sufficient oversampling. Since the feedback frequency control stage 30 operates in the discrete time domain, thus sampling the difference signal $e_T(t)$ at constant intervals.

Clearly, the difference signal $e_T(t)$ cannot be maintained completely constant at each sampling instant, since the control operates with an error correction on the basis of the previous values. For this reason, even after a proper settling time, the device 1 will present, at an idle operating condition, the difference signal $e_T(t)$ affected by a small amplitude ripple. Due to the discrete time domain operation of the integrator 33, and given an instant of sampling time (i) and a previous instant of sampling time (i−1), then the corrective signal $k_h$ at the instant (i), is given by:

$$k_h(i)=k_h(i-1)+K_1\cdot(e_T(i))$$

Where $e_T(i)$ represents the difference signal $e_T(t)$ sampled at the time instant (i), and $k_i$ is a tuning parameter (integration gain) of the integrator. As it is known, increasing the integration gain of the integrator 33 results in a reduced rise time of its response, as well as an increase of the overshoot time and the settling time. Thus the correct level of integration gain should be chosen considering the response of the rest of the components of the device 1, and also keeping into account the fuel injector operative frequency. The corrective signal $k_h(i)$ is always saturated to a magnitude comprised within the range (0÷1).

Multiplying the corrective signal $k_h(i)$ with the reference signal $V_{peak}$ results in obtaining the valley value of the signal $s_2$. Due to the fact that the corrective signal cannot exceed the unity, the valley value is forcedly kept lower than the reference signal's magnitude. Thus, the reference signal $V_{ref}$ is kept constant, that means that the maximum magnitude of the signal $s_1$ fed to the load 100 is fixed too, while the valley value of the signal $s_1$ changes according to the variation of $k_h$.

Figure 3:
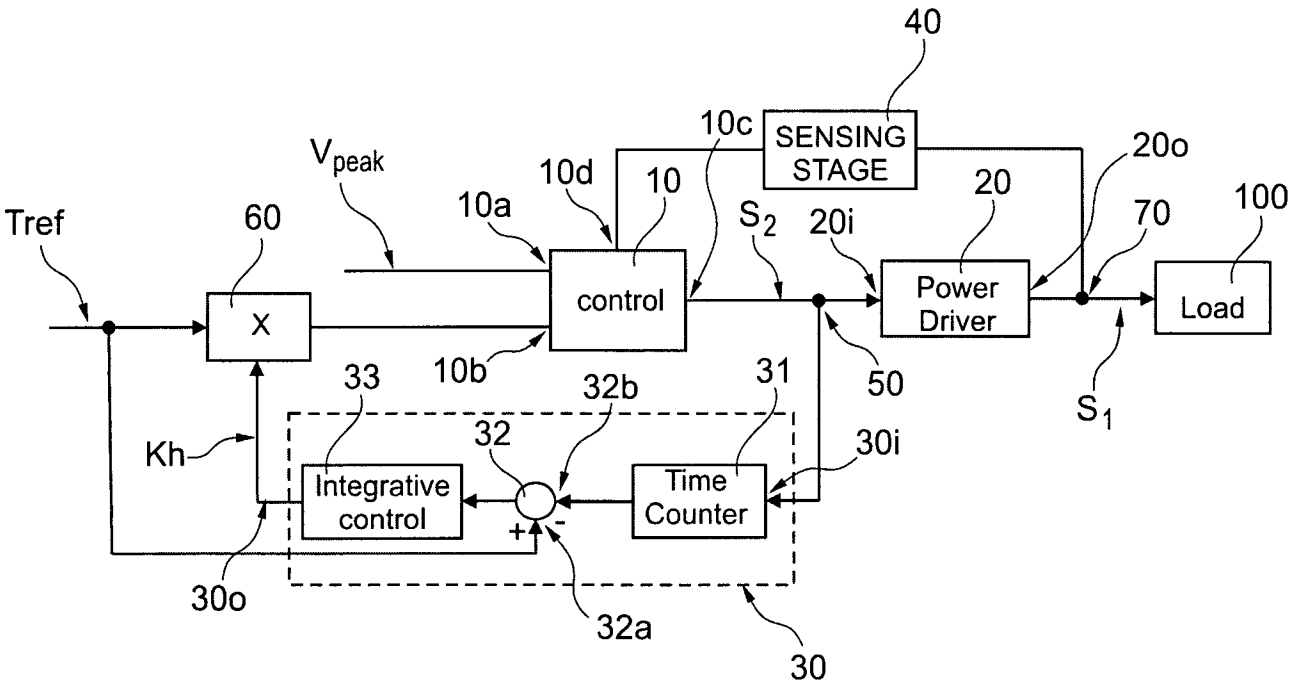
FIG. 3 shows a block scheme for a second embodiment of a hysteresis-type electronic controlling device for fuel injectors.

A second preferred embodiment of the device 1 is shown in FIG. 3. In the second embodiment, the reference values that are set by the designer are, as in the previous embodiment, the reference signal $V_{ref}$ and the reference timing signal $T_{ref}$. The frequency feedback control stage 30 keeps the same structure and the same inputs if compared to the one disclosed for the previous embodiment. This applies also to the configuration and functioning of the power driving unit 20, of the sensing stage 40 and the load 100.

In the second embodiment, the control stage 10 receives on the first and the second input port 10*a*, 10*b* respectively the reference signal $V_{ref}$ and the first time $T_{off}$ in which the signal $s_2$ assumes the first lower value. The first time $T_{off}$ is obtained from the output of the multiplier 60, that numerically multiplies the corrective signal $k_h$ and the reference timing signal $T_{ref}$, both fed to its inputs. In this second embodiment, the reference timing signal $T_{ref}$ is thus fed to the input of the multiplier 60 and, as happens in the first embodiment of the invention, to the adder's 32 input.

Thus the first and second embodiments still permit to obtain the same result with the same user defined inputs (the reference signal $V_{ref}$ and reference timing signal $T_{ref}$) and with the same circuit configuration. The internal operation of the control stage 10 and one of its inputs (the one that do not receive the reference signal $V_{ref}$) change from the first to the second embodiment. Also in the second embodiment the reference signal $V_{ref}$ is kept constant, that means that the maximum magnitude of the signal $s_1$ fed to the load 100 is fixed too, while the valley value of the signal $s_1$ changes according to the variation of $k_h$; in this case, in contrast, the variation of the valley value is indirect, and is produced to a direct variation of the first time $T_{off}$ through the action of the variation of $k_h$. Of course, the two circuits whose block schemes are represented in FIGS. 1 and 3 can be designed on a hardware (for example an ASIC) or implemented via software with one or more procedures run on a computer, leaving only the amplifier as an hardware block.

The advantages and benefits of the device previously disclosed are clear: it allows the avoidance of sub-harmonic instability that are present in classic peak current mode circuits and allows a simpler design and tuning with respect to frequency feedback circuits. In fact, the period measurement is executed using a simple counter, while a frequency measurement necessitates complex division stages in order to be effectively implemented. In addition, the presence of an integral control guarantees a smoothed variation of the hysteresis and a smoothed variation of the power driving unit 20. This produce a better functioning of the fuel injectors and, consecutively, an enhanced performance of the engine on which they are mounted on. Moreover, with the device herein disclosed it is possible to achieve a better frequency tuning of all the components of the circuit; the maintenance of a quasi-constant frequency, allows for a better filtering of the RF noise that is induced on the injectors.

In both the embodiments previously described, the reference timing signal $T_{ref}$ can be changed so as to adapt the device 1 functioning to a wide range of loads and system configurations without involving any modification in the interconnections of the circuit. Finally it is evident that modification and variations may be made to the device herein described, without departing from the scope of the present invention, as defined in the annexed claims.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

The invention claimed is:

1. A hysteresis-type electronic controlling device for fuel injectors, comprising:

a power driving unit configured to drive said fuel injectors with an electric signal ;

a control stage connected to said power driving unit;

a sensing stage fed by said power driving unit and feeding said control stage;

a feedback frequency control stage configured to measure a waveform period of said signal feeding the fuel injectors; said feedback frequency control stage fed by said control stag;

wherein said feedback frequency control stage comprises a time counter, and an integrator electrically connected to said time counter.

2. The hysteresis-type electronic controlling device according to claim 1, wherein said feedback frequency control stage further comprises an adder interposed between said time counter and said integrator.

3. The hysteresis-type electronic controlling device according to claim 2, wherein a reference signal and a reference timing signal are respectively applied to a first input of the control stage and to said adder.

4. The hysteresis-type electronic controlling device according to claim 3, wherein said integrator is configured to generate a corrective signal, said signal depending on an error signal produced by said adder.

5. The hysteresis-type electronic controlling device according to claim 4, further comprising a multiplier configured to feed a second input of said control stage.

6. The hysteresis-type electronic controlling device according to claim 5, wherein said multiplier comprises two inputs fed by said corrective signal and said reference timing signal.

7. The hysteresis-type electronic controlling device according to claim 5, wherein said multiplier comprises two inputs fed by said corrective signal and said reference signal.

8. A method for controlling fuel injectors, comprising:

driving said fuel injectors with an electric signal coming from a power driving unit fed by a control stage ;

sensing said signal with a sensing stage for feeding said control stage;

measuring a waveform period of said signal feeding the fuel injectors through a feedback frequency control stage fed by said control stage;

integrating an error signal produced from a difference between a measurement of the period of a driving signal produced by said control stage and a reference timing signal, wherein results of the integrating in a generation of a correcting signal that is multiplied with a reference signal;

feeding a first input port of said control stage with a first electric signal result of said multiplication; and feeding a second input port of said control stage with said reference signal.

9. The method according to claim 8, further comprising:

said driving signal assuming a first value at the output of said control stage when the electric signal is higher than the reference signal; and said driving signal assuming a second value when the electric signal is lower than the reference signal.

* * * * *